United States Patent [19]

Morita et al.

[11] Patent Number: 4,646,533

[45] Date of Patent: Mar. 3, 1987

[54] REFRIGERANT CIRCUIT WITH IMPROVED MEANS TO PREVENT REFRIGERANT FLOW INTO EVAPORATOR WHEN ROTARY COMPRESSOR STOPS

[75] Inventors: Mitsuru Morita, Kashiwara; Hitoshi Nasu, Higashiosaka, both of Japan

[73] Assignee: Natsushita Refrigeration Company, Higashiosaka, Japan

[21] Appl. No.: 777,562

[22] Filed: Sep. 18, 1985

Related U.S. Application Data

[63] Continuation of Ser. No. 554,391, Nov. 22, 1983, abandoned.

[30] Foreign Application Priority Data

Dec. 2, 1982 [JP] Japan ..... 57-212232

[51] Int. Cl.[4] ..... F25B 41/04

[52] U.S. Cl. ..... 62/225; 62/205

[58] Field of Search ..... 62/204, 205, 210, 211, 62/511, 206, 224, 222, 225, 216, 208; 137/533, 533.17, 533.19

[56] References Cited

U.S. PATENT DOCUMENTS

| | | | |
|---|---|---|---|
| 1,782,687 | 11/1930 | Hoffman | 62/205 |
| 2,326,093 | 8/1943 | Carter | 62/225 X |
| 2,331,264 | 10/1943 | Carter | 62/225 X |

FOREIGN PATENT DOCUMENTS

| | | | |
|---|---|---|---|
| 803832 | 10/1936 | France | 137/533.17 |
| 811326 | 4/1937 | France | 62/208 |

*Primary Examiner*—Harry Tanner

*Attorney, Agent, or Firm*—Cushman, Darby & Cushman

[57] ABSTRACT

In a refrigerating apparatus comprising a rotary compressor, a pressure-controlled valve is inserted in a path between a condenser and an evaporator and a reverse flow check valve is inserted between the evaporator and a suction line connected to the input port of the rotary compressor, thereby to eliminate undesirable heat load caused by undesirable flow-in of the refrigerant gas into the evaporator after the rotary compressor stops.

6 Claims, 9 Drawing Figures

REFRIGERANT CIRCUIT WITH IMPROVED MEANS TO PREVENT REFRIGERANT FLOW INTO EVAPORATOR WHEN ROTARY COMPRESSOR STOPS

This is a continuation of application Ser. No. 554,391, filed Nov. 22, 1983, which was abandoned upon the filing hereof.

BACKGROUND OF THE INVENTION

1. Field of the Invention:

The present invention relates to improvements in refrigerating apparatus. The present invention particularly concerns a refrigerating apparatus such as refrigerator, freeze stocker, refrigeration or freezing show-case etc. which employs a hermetically sealed compressor of the high pressure type, especially a rotary compressor having a fluid check valve in its refrigerant circuit.

2. Description of the Prior Art:

Generally, in small type refrigerating apparatus having a closed type high pressure compressor, such as, a rotary compressor, the space in the compressor housing is under high pressure. Accordingly such refrigerating apparatus requires a considerably larger volume of refrigerant in comparison with the conventional low pressure closed compressor, such as a reciprocation type compressor. As one example, a home use freezer refrigerator of the reciprocation type compressor needs about 150 gr of refrigerant, but the rotary compressor type home use freezer refrigerator of the same size requires about 250 gr of refrigerant which is about a 50% or more increase. The increment portion, namely 100 gr of refrigerant, exists partly as a high temperature and high pressure super-heated gas and partly as liquid phase gas mixing in the compressor oil. At the time immediately after the compressor is stopped by a thermostat, the gas phase and liquid phase of parts the refrigerants are heated, with the liquid phase being vapourized into the gas phase, by high temperature parts of the compressor. Thereby, both parts become high temperature and high pressure super heated gas, which flow back to an evaporator connected to the refrigerant inlet port of the compressor. The above-mentioned situation of the general operation scheme of the conventional rotary type compressor is elucidated with reference to FIG. 1.

The refrigerant circuit connects from a rotary compressor 1 through a condenser 4, a capillary tube 6, as a pressure decreasing member, an back evaporator 7 and to the rotary compressor 1. The refrigerant gas is compressed by the rotary compressor 1 and issued as a high temperature and high pressure super heated gas and delivered to the condenser 4, where the gas is cooled to normal temperature and is delivered through the capillary tube 6 where the refrigerant is changed to a liquid phase, and fed to the evaporator 7. When the compressor motor stops usually by means of operation of thermostat (not shown), the high temperature and high pressure super heated gas in the rotary compressor housing 2 goes out on one hand through the condenser 4 and capillary tube 6 to the evaporator 7 and on the other hand through the suction tube 9 reversely to the evaporator 7. Since this high pressure and high temperature super-heated refrigerant gas is a large heat load on the evaporator 7, such out-flow of the refrigerant gas after the rotary compressor 1 stops is not desirable. Such out-flow of the refrigerant gas from the rotary compressor 1 to the outside of its housing is inevitable since the conventional rotary compressor 1 uses mechanical seals, which theoretically cannot seal the refrigerant gas completely. Thus the conventional refrigerating apparatus using a rotary compressor 1 has the shortcoming of the refrigerant gas's flowing out towards the evaporator to impose a large heat load thereto. Accordingly, even by using a rotary compressor, which has about 20% higher efficiency than a conventional reciprocal compressor, the actual electric freezer refrigerator or electric refrigerator defined in the Japanese industrial standard (JIS) C9607, which corresponds to the standard of association of home appliance manufacturers (AHAM)HRF-1, has only about 5% a power saving. In order to improve power saving, it is necessary to stop undesirable flowing of the large amount of high temperature super-heated gas from the outlet port and inlet port of the compressor 1 stops. For such purpose, the conventional improvement has been made, as shown in FIG. 2, to provide a check valve CV in the suction line 9 which is the path from the evaporator 7 to the inlet port of the rotary compressor housing 2. However, even in such improved apparatus of FIG. 2, since the path between the output port of the rotary compressor housing and the evaporator 7 has no particular means to stop undesirable flowing of the high temperature super heated refrigerant gas, power saving of only about 5% is achieved, thus achieving only about 10% overall power saving over that of the older prior art of FIG. 1.

Still another conventional improvement has been made as shown in FIG. 3, by providing an electromagnetic valve MV in the refrigerant path between the condensor 4 and the capillary tube 6, but such electromagnetic valve is expensive, makes a big noise in operation and further requires a control circuit therefore and power for its operation.

SUMMARY OF THE INVENTION

A purpose of the present invention is to provide an improved refrigerating apparatus, wherein the above-mentioned shortcomings are solved by providing a fluid controlled valve which is controlled by the rapid pressure change that occurs when the rotary compressor stops. Thereby undesirable flowing into the evaporator of the heated refrigerant gas from the rotary compressor is prevented, thereby eliminating the undesirable heat load and effectively improving the power saving efficiency without the use of a complicated electric circcuit.

DETAILED DESCRIPTION OF THE INVENTION

In order to achieve the above-mentioned purpose of the present invention, the present apparatus utilizes a fluid controlled valve which comprises a valve member to be operated in response to the pressure of a suction line which is connected to the inlet port of a rotary compressor and controlled to inhibit undesirable out flowing of high temperature high pressure refrigerant from the rotary compressor housing into the evaporator after stopping of the rotary compressor.

The refrigerating apparatus in accordance with the present invention comprises:

a rotary compressor, a condenser, an expansion device, an evaporator and a check valve for prevention of reverse flow of refrigerant in the suction line of the rotary compressor, all connected series with each other constituting a closed circuit with respect to the refrigerant contained therein, characterized by a fluid-controlled valve for controlling flow of the refrigerant to the expansion device, the control valve comprising a first chamber and a second chamber separated by a pressure-responsive member, the first chamber containing a valve member to be connected into the circuit of the evaporator to control flow of said refrigerant to the evaporator in response to pressure of the second chamber, which is connected into the circuit downstream of the check valve.

As a result of the above-mentioned configuration, during operation of the rotary compressor, the second valve chamber is impressed with a low pressure which is equivalent to the evaporation pressure; and during a stopping of the rotary compressor a high pressure which is substantially equal to that of the high pressure side of the rotary compressor is impressed from the suction line which is at the inlet port of the rotary compressor housing 2 to the second chamber. Thereby a pressure-responsive diaphragm of the fluid control valve is moved by the change of the pressure to close the valve in the first chamber. Then, when the pressure in the second chamber is low, the valve in the first chamber is opened and when the pressure of the second chamber is high, the valve is closed. Therefore, the valve is closed when the compressor motor stops, thereby to prevent undesirable flowing of the high temperature high pressure super-heated gas into the evaporator from both its ends.

EXAMPLE 1

Figure 1:
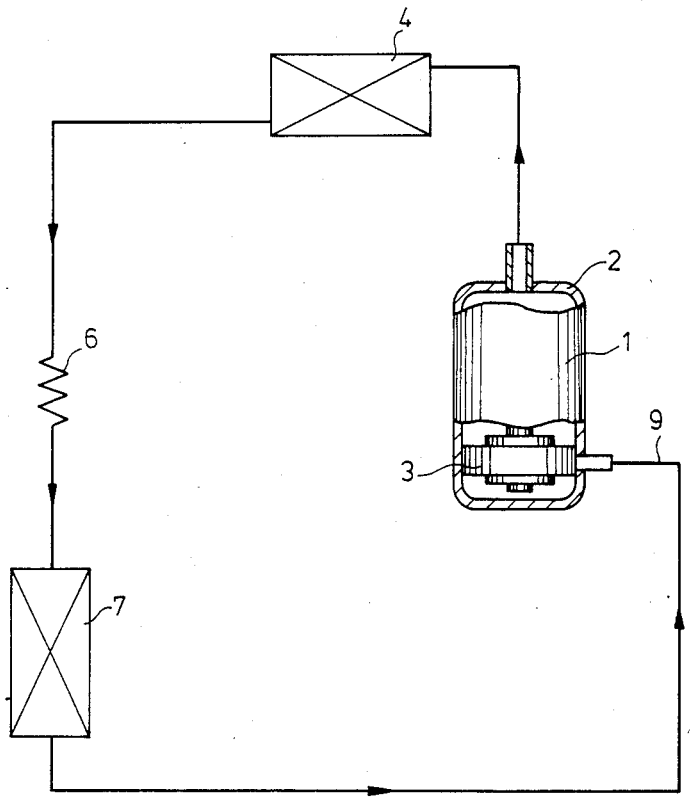
FIG.1 (Prior Art)
FIG. 1 is a fluid circuit diagram of a conventional refrigerating apparatus.
Figure 2:
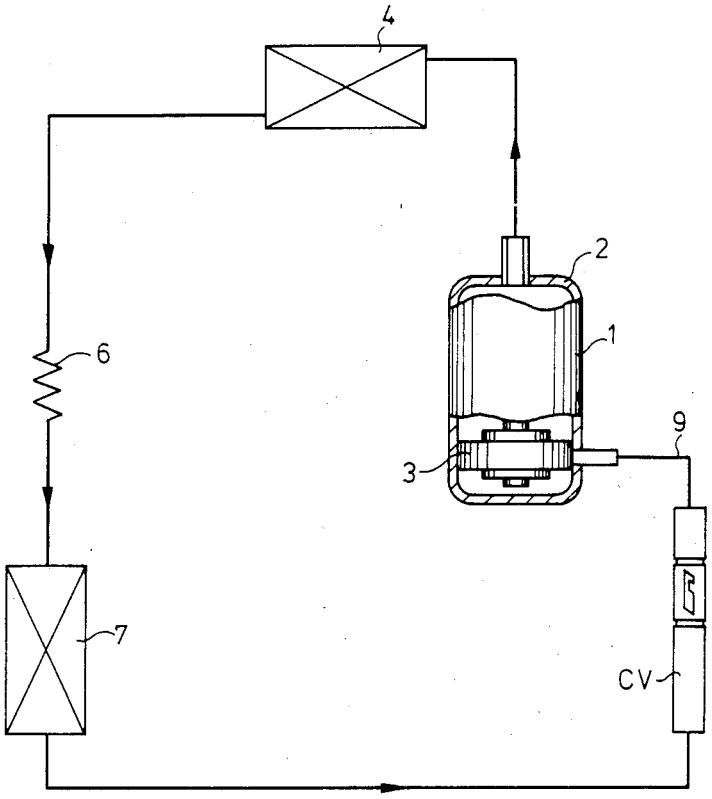
FIG. 2 (Prior Art)
FIG. 2 is a fluid circuit diagram of another conventional refrigerating apparatus.
Figure 3:
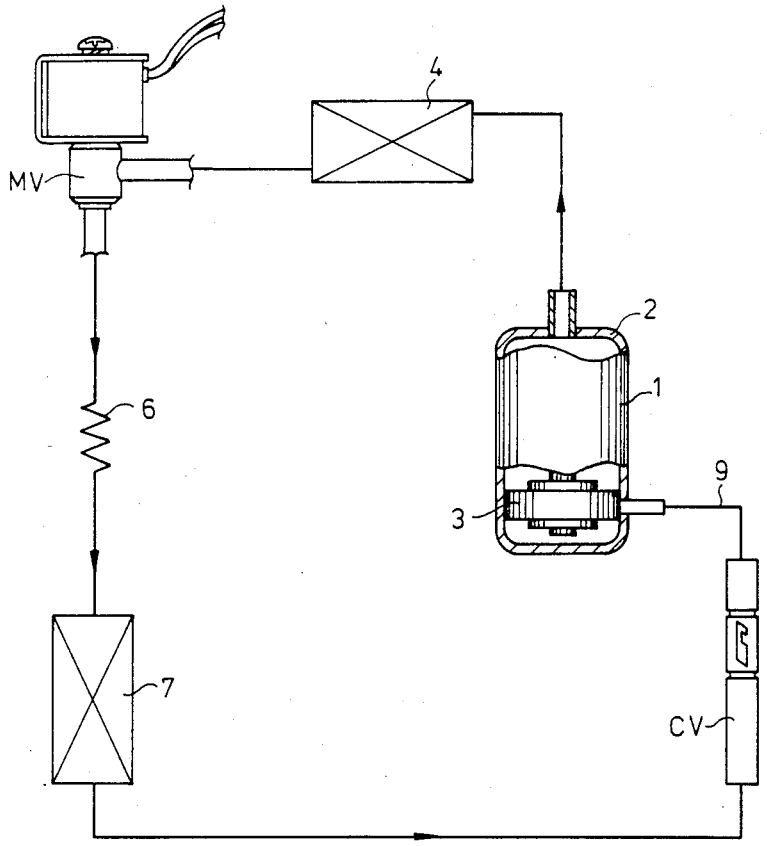
FIG.3 (Prior Art)
FIG. 3 is a fluid circuit diagram of another conventional refrigerating apparatus.
Figure 4:
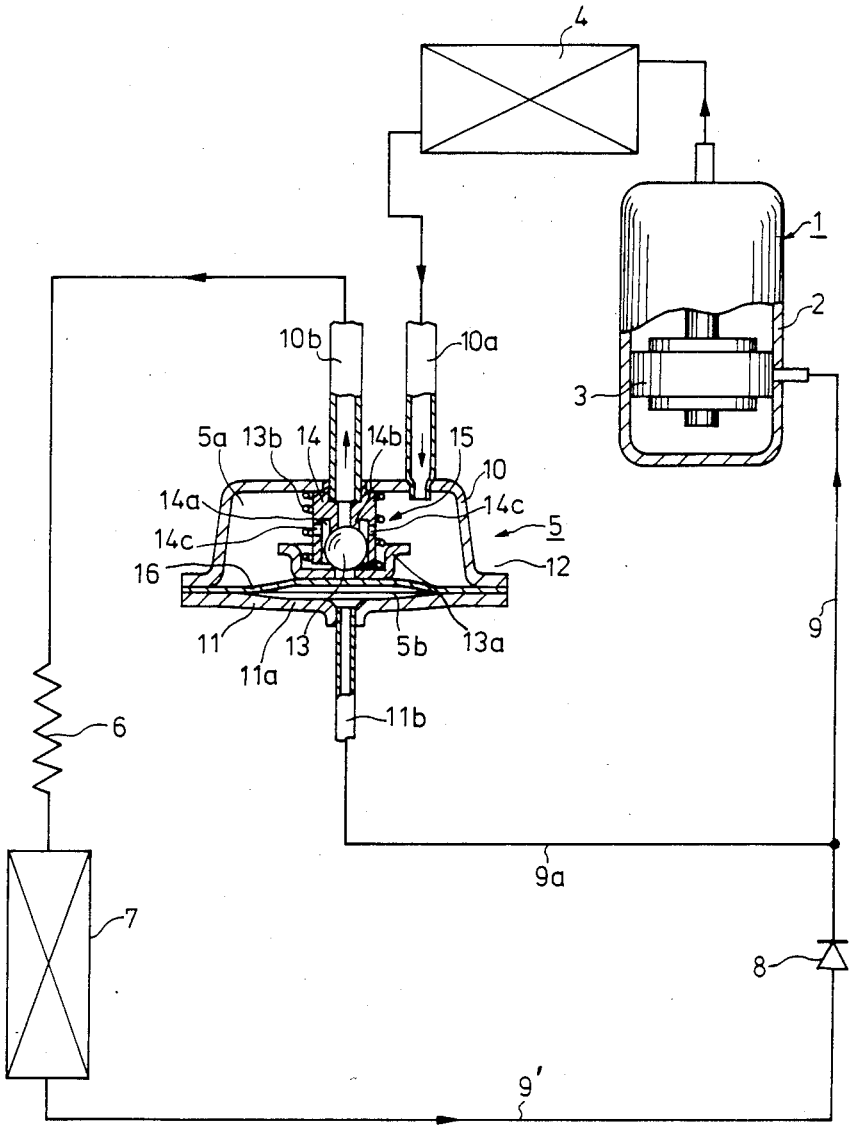
FIG. 4 is a fluid circuit diagram of a refrigerating apparatus embodying the present invention with sectional views for some components.

FIG. 4 shows a fluid circuit diagram, with necessary component in sectional view, of a first example. A rotary compressor comprises a sealed container 2 which contains therein, compressor 3 and a motor (not shown) to drive it. The refrigerant apparatus comprises the rotary compressor 1, a condenser 4, a fluid-controlled valve 5, a capillary tube 6 as an expansion device, an evaporator 7 and a reverse flow check valve 8 connected in series to form a fluid circuit. The reverse flow check valve is for stopping reverse flow of refrigerant to the evaporator 7 to the suction line 9. A first chamber 5*a* of the fluid-controlled valve 5 is connected by its inlet port 10*a* to the condenser 4 and by its outlet port 10*b* to the capillary tube 6. The second chamber 5*b* of the fluid-controlled valve 5 is connected by a branch line 9*a* to the suction line 9 between the reverse flow check valve 8 and the inlet port of the rotary compressor 1, so that the pressure of the suction line 9 is impressed in the second chamber 5*b*. The fluid-controlled valve 5 comprises a first shell 10 and a second shell 11 and a pressure-responsive diaphragm 16, wherein the first shell 10 and the diaphragm 16 define the first chamber 5*a* and the second shell 11 and the diaphragm 16 define the second chamber 5*b*, i.e. the diaphragm separates the chamber. The first chamber has an inlet port 10*a* which is simply connected to the space of the first chamber 5*a* and a second port 10*b*, which is connected to a valve block 14 having a concave valve seat 14*b* at its inner end to receive a valve ball 13 as a valve member. The valve block 14 has a sleeve extension surrounding the seat 14 *b* several holes 14*c*, 14*c* . . . formed therein adjacent the seat 14*b*. The valve ball 13 is fixed on a plate 13*a* which rests on the diaphragm 16 and is urged by a coil spring 13*b* in a direction to unseat the valve ball 13. The diaphragm 16 has a predetermined spring force to push the valve ball 13 toward the valve seat 14.

On the other hand, the second chamber 5*b* is formed very shallow, so that undesirable excessive unseating movement of the diaphragm 16 is prevented by the second shell 11. The port 11*b* is connected to a center hole of the second chamber 5 *b*.

OPERATION OF FIG. 4

Firstly, the state of the fluid circuit during operation of the rotary compressor 1 is described. High temperature high pressure refrigerant is issued from the rotary compressor 1, and is delivered to the condenser 4 where the high temperature high pressure refrigerant is relieved of its heat energy. That is, the refrigerant of high temperature is cooled down in the condenser 4, and becomes a high pressure refrigerant mainly of liquid phase and is led into the first chamber 5*a*. And accordingly, the high pressure of the refrigerant is impressed on the diaphragm 16. In this operation state of the rotary compressor 1, a very low pressure in the suction tube 9 is communicated by a branch tube 9*a* to the second chamber 5*b*. Accordingly, the diaphragm 16, which has a prestressed tension in a direction to close the valve 15, is moved in a direction to open the valve by the pressure difference between the high pressure in chamber 5*a* and the low pressure in the chamber 5*b*. Then, the diaphragm is pushed down substantially to the position where it touches the shell 11*a*, since the downward pressure impressed on the diaphragm 16 is far greater than the prestressed upward force thereby to press it against the inner face of the shell 11. Since the plate 13*a* is always urged to unseat the ball 13 by means of the spring 13*b*, the valve ball 13 is then removed from the valve seat 14*b* thereby opening the valve 15. Accordingly, the refrigerant fluid passes through connecting holes 14*c*, 14*c*, . . . , goes out through the outlet port 10*b*, and is led to the capillary tube 6. Thereafter, the fluid refrigerant travels into the evaporator 7 where it evaporates and absorbs heat and passes through the check valve 8 and suction line 9, returns to the inlet port of the rotary compressor 1, and the process is repeated continuously.

Secondly, the operation immediately after a stopping of the rotary compressor is described. When the rotary compressor 1 stops, the high temperature high pressure refrigerant gas in the rotary compressor 1 leaks out through mechanical seal parts into the closed housing 2, and on the other hand from the inlet port of the rotary compressor 1 through the suction line 9 towards the branch tube 9*a* and to the second chamber 5*b* of the fluid-controlled valve 5, since reverse flow towards the evaporator 7 is prohibited by the check valve 8. Thus the pressure of the suction tube 9 and accordingly, the pressure of the second chamber 5*b* of the fluid-controlled valve 5 is raised to a high pressure in a very short time, which is substantially the same as that of the high pressure in the housing 2. Accordingly, the pressure of the first chamber 5*a* and the second chamber 5*b* becomes almost equal. Then, the diaphragm 16 by its prestressed nature, so that the valve ball 13 seats on the valve seat 14*b* and closes the valve 15. Accordingly, flow of the high temperature high pressure gas through the condenser 4 and the capillary tube 6 to the evaporator 7, is prevented.

Next, the operation of the fluid circuit of FIG. 4, when the rotary compressor 1 restores its operation is described.

Since the pressure of the suction line 9 rapidly decreases as a result of the operation of the rotary compressor 1, the second chamber 5*b* of the fluid-controlled valve 5 also rapidly decreases, and therefore the diaphragm 16 is pressed down as a result of the high temperature high pressure gas in the first chamber 5*a* surpassing the resilient force of the diaphragm 16. Therefore, the valve ball 13 unseats on the downward movement of the plate 13*a* by the pressure spring 13*b*, thereby opening the valve 15 and allowing flow of the refrigerant gas from the rotary compressor 1 to the capillary tube 6 to carry out a normal refrigerating operation.

When the rotary compressor 1 is stopped, the first chamber 5*a* and the second chamber 5*b* are both held both at high pressures and therefore the pressures on both faces of the diaphragm 16 are substantially balanced, and the pressure in the outlet port 10*b* of the fluid-controlled valve 5 becomes lower than that of the first chamber 5*a*. Accordingly, the valve ball 13 is pressed up to the valve seat of the valve block 14 with a high pressure which is the difference between the high pressure in the first chamber 5*a* and a lower pressure in the outlet port 10*b* of the fluid-controlled valve 5. Thereafter, when the operation of the rotary compressor 1 restores, the pressure of the suction line 9 becomes negative, and accordingly, the pressure in the second chamber 5*b* rapidly decreases, thereby the diaphragm 16 moves downward. In this case, the valve ball 13 must unseat to open the valve. Accordingly the spring 13*b* which is pressing down the plate 13*a*, to which the valve ball 13 is fixed, must have a sufficient pressing force so as to unseat the valve ball 13. By selecting the strength of the spring 13*b* in the above-mentioned manner, when the rotary compressor 1 starts operation, the fluid-controlled valve 5 is open to open the path from the condenser 4 to the capillary tube 6. The pressure impressed on the diaphragm 16 is such that, in the first chamber 5*a* the pressure is always high, and in the second chamber 5*b* the pressure is low during the operation of the rotary compressor 1 and substantially high during the stopping of the rotary compressor 1. Since the second chamber 5*b* is connected to the inlet port of the rotary compressor 1, the difference of the pressure on both surfaces of the diaphragm 16 rapidly changes on change of operation of the rotary compressor 1. And the fluid-controlled valve 5 is surely operated. Since the fluid-controlled valve 5 is fully open during operation of the rotary compressor 1, it does not influence the normal refrigerating operation of the refrigerating apparatus, and during the stopping of the rotary compressor 1 the evaporator 7 is completely isolated from the undesirable in-flow of refrigerant by the closing of the fluid-controlled valve 5 and by automatic prevention of the reverse in-flow from the inlet port of the closed housing 2. Therefore, undesirable heat load on the evaporator 7 is prevented.

EXAMPLE 2

Figure 5:
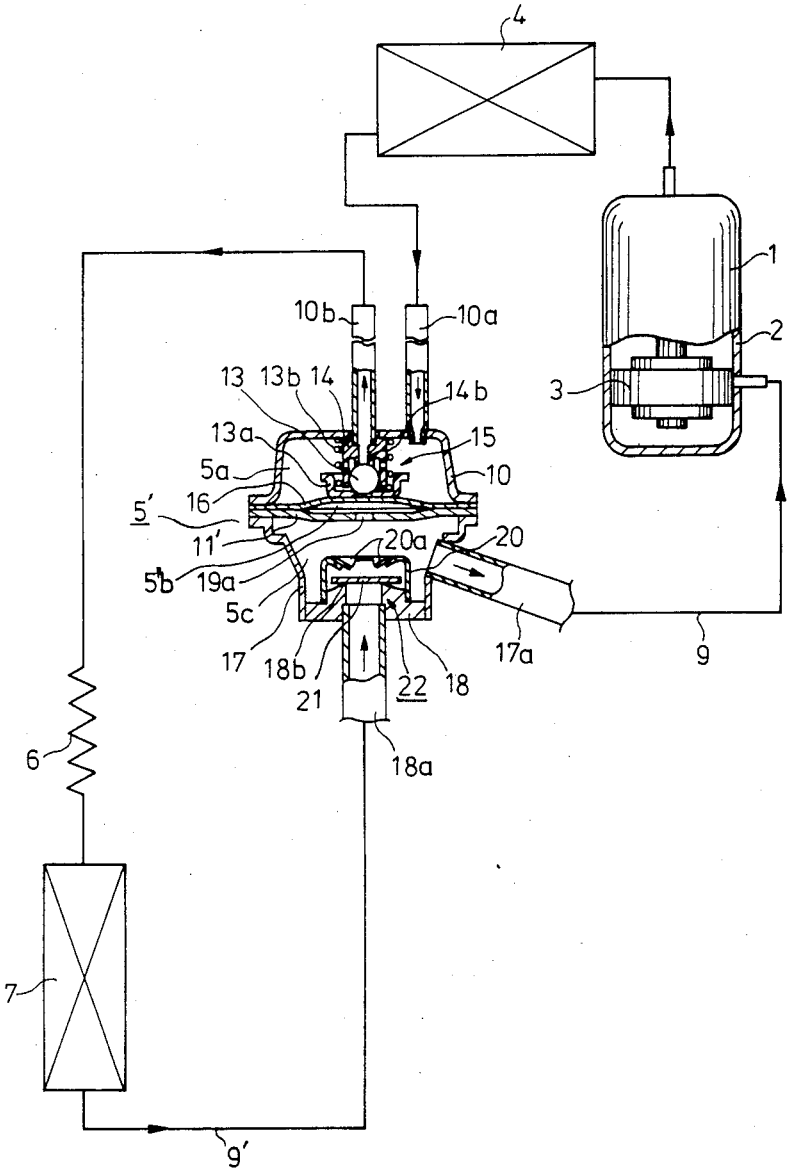
FIG. 5 is a fluid circuit diagram of another refrigerating apparatus embodying the present invention with sectional views for some components.

FIG. 5 shows a second example, wherein components and parts corresponding to those of the first example are shown by the corresponding numerals and the corresponding descriptions for the first example apply.

The feature of this second example is that the reverse flow check valve in the first example is combined in the fluid-controlled valve 5', so that the piping becomes simpler than that of the example 1. The fluid controlled valve 5' is configured substantially in the same structure in its first chamber 5*a* and the lower part of the fluid-controlled valve 5' is modified so as to contain the reverse flow check valve therein. The analogous components and parts of the foregoing examples are designated by the corresponding primed numerals. The second chamber 5'*b* is defined by a retainer 11' having a through-hole 19*a*. A lower shell 17 and a second valve block 18 having a second valve seat 18*b* at the upper surface and having a through-hole connected to an inlet port 18*a*. The lower shell 17 has a side hole which is connected to the outlet port 17*a* to be connected to the inlet port of the rotary compressor 1 through the suction line 9. The second block 18 has a retainer 20 having several openings 20*a* on its top face and covering a leaf valve 21 thereunder and above the second valve seat 18*b*. The lower face of the retainer 20 has several protrusions for point contacting with the upper face of the leaf valve 21, in order to avoid undesirable sticking with the oil contained in the refrigerant. Therefore the part in the retainer constitutes a reverse flow check valve 22. The inlet port 18*a* is connected to the evaporator 7 through a line 9', the outlet port 17*a* is connected between the suction line 9 and the third chamber 5*c* of the fluid-controlled valve 5'. Therefore the third chamber 5*c* has the pressure which is at the downstream side of the reverse flow check valve 22.

The operation of the fluid controlled valve 5' as respects the first chamber 5*a* and the second chamber 5*b* is identical to the operation the value of example 1, and the operation of the reverse flow check valve 22 in the third chamber 5*c* is identical to the reverse flow check valve of example 1. That is, when the rotary compressor 1 is operated and the refrigerant gas is flowing in the direction shown by the arrows, the leaf valve 21 is pushed up by the refrigerant flow, and the refrigerant can pass from the inlet port 18*a*, through the third chamber 5*c* and to the outlet port 17*a*.

The fluid controlled valve 5' of this example 2 has the feature that, during the operation of the rotary compressor 1, the super heated high temperature high pressure refrigerant passing through the first chamber 5*a* is heat-exchanged through the diaphragm 16 with the low temperature low pressure refrigerant passing through the third chamber 5*c* and the second chamber 5*b*. Accordingly, the high temperature high pressure super heated refrigerant is sub cooled by the low pressure low temperature refrigerant, thereby refrigeration efficiency is improved. Furthermore, since the heat-exchanging is made by making the first chamber 5*a* and the third chamber 5*c* and the second chamber 5'*b* to be disposed adjacent to each other with the diaphragm 16 inbetween, the heat-exchange can be made efficiently.

EXAMPLE 3

Figure 6:
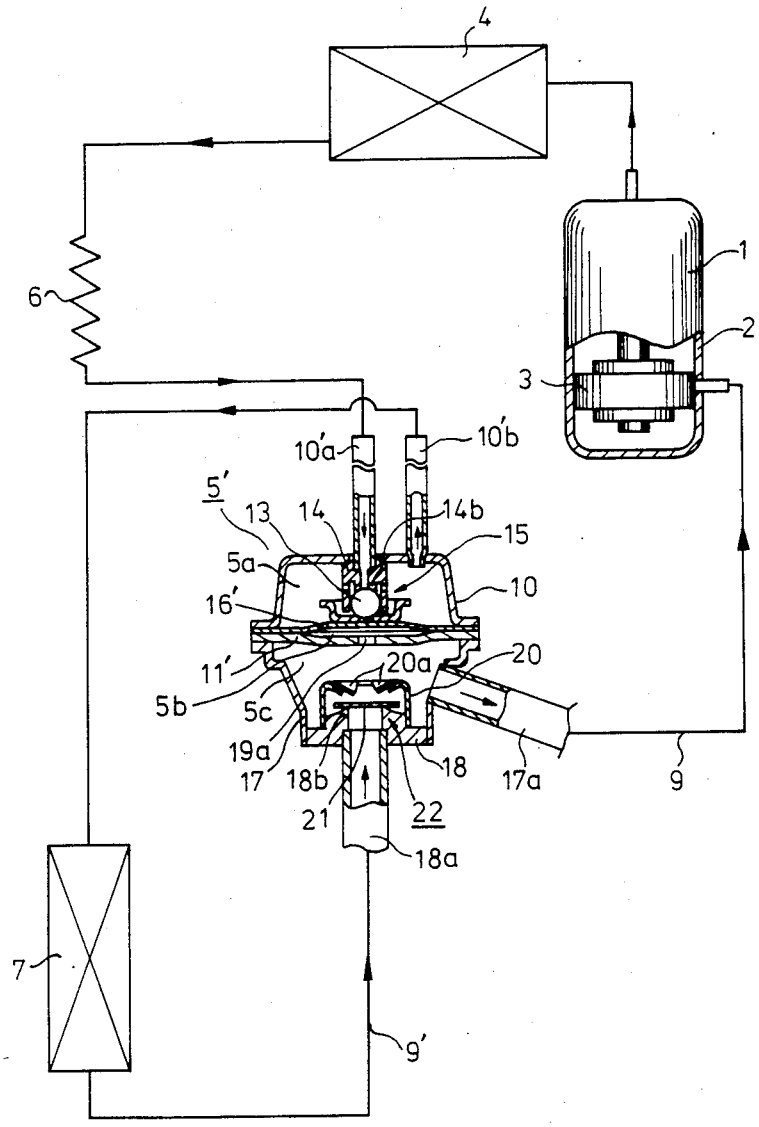
FIG. 6 is a fluid circuit diagram of another refrigerating apparatus embodying the present invention with sectional views for some components.

FIG. 6 shows a configuration of the third example wherein components and parts corresponding to those of the second example are shown by corresponding numerals and the corresponding descriptions made for the first example apply. The analogous components and parts of the foregoing examples are designated by corresponding primed numerals.

The feature of this example 3 is that the first chamber 5*a* of the fluid-controlled valve is connected between the capillary tube 6 and the evaporator 7. In this example, the central port 10'*a* of the first chamber 5*a* is connected as an inlet port from the capillary tube 6, and the side port 10'*b* of the first chamber 5*a* is connected as an outlet port to the evaporator 7. That is, the connections of the central port 10'*a* and the side port 10'*b* of the first chamber 5' with respect to the direction of the refrigerant flow is opposite to those of example 1 and example 2. That is, the valve ball 13 is situated between the inlet port 10'*a* and the first chamber 5*a*, and the inlet port 10'*a* is connected to the outlet end of the capillary tube 6 and the outlet port 10'*b* is connected to the inlet end of the evaporator 7. The inlet end of the capillary tube 6 is directly connected to the condenser 4. In this example, the diaphragm 16' which defines the boundary between the first chamber 5*a* and the second chamber 5*b* is prestressed in such a direction as to open the valve ball 13 by moving downwards when pressures on both surfaces of the diaphragm 16' are substantially equal. Furthermore, the pressure spring 13*b* provided in the preceding example 1 and example 2 are omitted here in the third example of FIG. 6, because there is no fear that the valve ball 13 is pushed up to the valve seat 14*b* by the pressure of the refrigerant gas in the first chamber 5*a*. Other configurations of the fluid controlled valve 5', that is, the configurations of the second chamber 5*b* and the third chamber 5*c* and connections of the lower inlet port 18*a* and the lower outlet port 17*a* are the same as those of the example 2.

The operation of the example 3 is as follows. FIG. 6 shows the state when the rotary compressor 1 is in operation. That is, during the operation of the rotary compressor 1, the diaphragm 16', hence, the valve ball 13 is in the downward shifted position (not shown), thereby opening the valve 15 in the first chamber 5*a*.

During the operation of the rotary compressor 1, the known refrigerating operation is made by the compressing action of the rotary compressor 1, subsequent condensation in the condenser 4, subsequent lowering of the pressure in the capillary tube 6 and finally evaporation in the evaporator 7. In such refrigerating operation, the pressure in the first chamber 5'*a* of the fluid controlled valve 5' is substantially the same as that of the evaporator 7, and the pressure of the second chamber 5*b* is substantially the same as that of the suction line 9, and the evaporator has only small impedance against the flow of the refrigerant gas, therefore the pressure of the first chamber 5*a* and that of the second chamber 5*b* are almost the same. Accordingly, the valve 15 is open, since the diaphragm 16' is prestressed downwards as has been described. And also the valve ball 13 is pushed by dynamic presssure energy of the refrigerant gas coming in through the inlet port 10'*a*. On the other hand, the reverse flow check valve 22 is structured in the same way as that of the example 2 of FIG. 5, therefore the refrigerant gas can flow normally refrigerating the evaporator 7.

Nextly, the state after the rotary compressor 1 stops is described.

After the rotary compressor 1 stops its operation, the high temperature high pressure refrigerant gas in the closed housing 2 leaks through mechanical seal part to the cylinder chamber (not shown), and thereafter the high temperature high pressure refrigerant gas flows out through the suction line 9 to the third chamber 5*c* of the fluid controlled valve 5'. By such reverse flow of the refrigerant gas, the leaf valve 21 of the reverse flow check valve 22 closes, and thereby the pressure in the thrid chamber 5*c* makes an equilibrium with the pressure of the refrigerant gas in the closed housing 2. On the other hand, the capillary tube 6 has a considerable impedance against the flow of the refrigerant gas. Therefore, making of an equilibrium of the pressure of the high temperature high pressure gas in the closed housing 2 through the condenser 4, capillary tube 6, the first chamber 5*a* of the fluid controlled valve 5' and the evaporator 7 takes some time. Accordingly, the pressure on the lower surface of the diaphragm 16 becomes considerably higher than that of the upper surface, and with this pressure difference the diaphragm 16 is pushed upwards. Accordingly, the valve ball 13 is pushed up to the valve seat 14*b* and closes the valve 15. Then, within a certain time period, the pressure of the refrigerant gas in the closed container 2, condenser 4, the capillary tube 6 and the first chamber 5*a* comes into equilibrium. Since the area of the valve seat 14*b* of the valve 15 is very small in comparison with the area of the diaphragm 16, a sufficient force to retain the valve 15 closed is provided by the diaphragm 16. since the valve 15 in the first chamber 5*a* and the second valve 22 in the third chamber 5*c* close the inlet side and outlet side of the evaporator 7, there is no fear that the high temperature high pressure refrigerant gas undesirably flows into the evaporator 7 after stopping of the rotary compressor 1 giving an undesirable heat load 2 to the evaporator.

EXAMPLE 4

Figure 7:
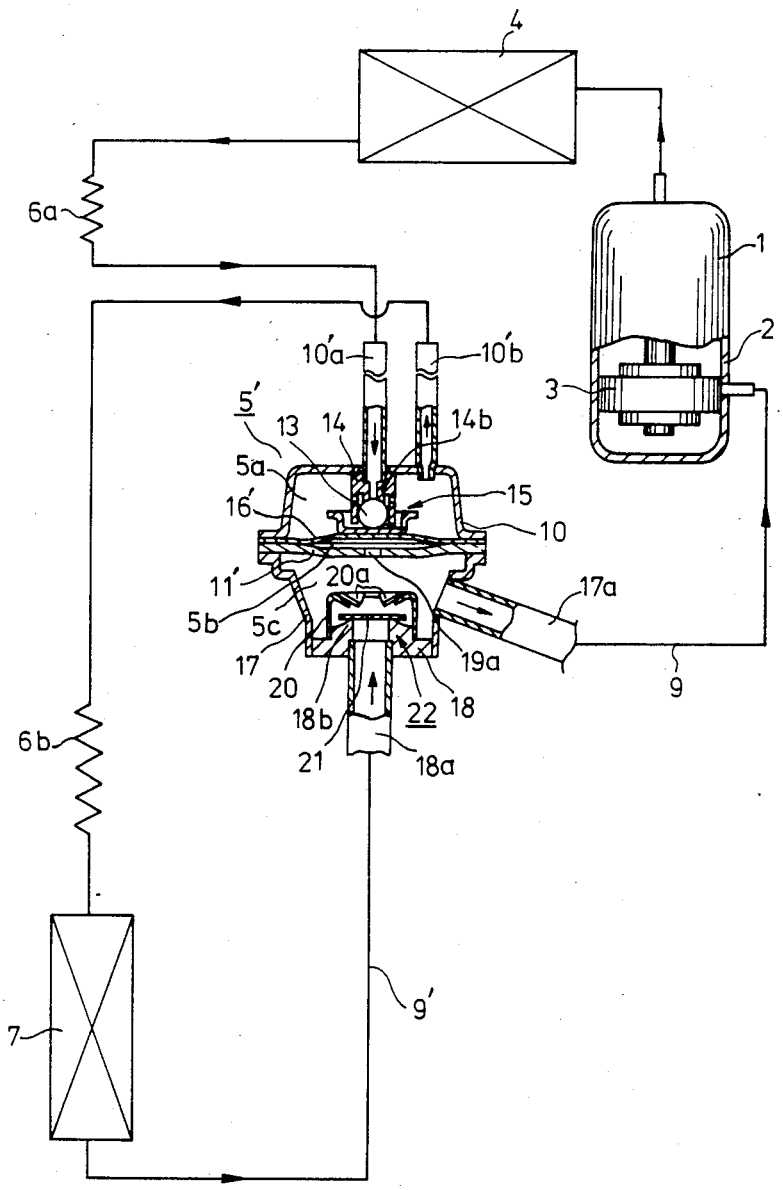
FIG. 7 is a fluid circuit diagram of another refrigerating apparatus embodying the present invention with sectional views for some components.

FIG. 7 shows a fourth example, wherein components and parts corresponding to those of the third example are shown by corresponding numerals and the corresponding descriptions made for the first example apply.

The analogous components and parts of the foregoing examples are designated by the corresponding primed numerals.

The feature of this example 4 is that the first chamber 5*a* of the fluid-controlled valve 5' is connected between a first part capillary tube 6*a* and a second part capillary tube 6*b*. The configuration of the fluid controlled valve 5' is the same as that of the example 3 shown in FIG. 6. The center port 10*a* of the fluid controlled valve 5' is connected to the outlet end of the first part capillary tube 6*a* and the side port 10*b* of the fluid-contolled valve 5' is connected to the inlet side of the second part capillary tube 6*b*.

Nextly, the operation of the example 4 is described.

During the operation of the rotary compressor 1, the compressed refrigerant gas is led through the condenser 4 and the pressure is decreased partly in the first capillary tube 6*a* and the partly-decreased pressure gas is led to the first chamber 5*a* of the fluid controlled valve 5' through its central inlet port 10*a* and the valve 15. On the other hand, by sucking action of the rotary compressor 1, the pressure in the suction line 9 is lowered, and the pressure in the third chamber 5*c* is decreased. And thereby the diaphragm 16 is pressed down by the pressure difference between its upper side high pressure, the lower side low pressure, and its downward prestressed nature, thereby to open the valve ball 13 of the valve 15 in the first chamber 5*a*. Therefore, the refrigerant gas flows through the first chamber 5*a* into the second capillary tube 6*b*, and thereby its pressure is decreased to a predetermined level and led to the evaporator 7. The second valve 22 is open since the pressure in the third chamber 5*c* is lower than that in the inlet port 18*a*, thereby the returning refrigerant gas passes through the third chamber 5*c* and the suction line 9, and returns to the inlet port of the rotary compressor 1.

Next, the operation after a stopping of the rotary compressor 1 is described. On the stopping of the rotary compressor 1, the high temperature high pressure mechanical seal part to the inside space of the sealed housing 2, and through the suction line 9 reversely flows into the third chamber 5*c* of the fluid-controlled valve 5'. By this reverse flow of the high temperature high pressure refrigerant gas into the third chamber 5*c*, the reverse flow check valve 22 is closed and the pressure in the suction line 9 rapidly increases until it comes into equilibrium with the pressure in the closed housing 2. On the other hand, since the impedance against the flow of the refrigerant gas in the capillary tuber 6*a* and 6*b* is high, the pressure in the first chamber 5*a* of the fluid-controlled valve 5' is retained at a medium side and the low pressure side of the rotary compressor 1 during the normal operation of the rotary compresssor 1. And therefore, the upper surface of the diaphragm 16 receives the medium pressure, and the lower surface of the diaphragm 16 receives the high pressure impressed through the suction line 9, the third chamber 5*c* and a through-hole 19*a*. Accordingly, the diaphragm 16 is pushed upwards by the difference of the pressures on both surfaces and the prestressed bending force of the diaphragm 16 itself, thus pressing the valve ball 13 to the valve seat 14*b* to close the valve 15 in the first chamber 5*a*. By the closing of the valve 15, the pressure in the central inlet port 10'*a* comes into equilibrium with the high pressure of the closed housing 2 of the rotary compressor 1.

In this state, since the cross-sectional area of the port in the valve seat 14*b* is much smaller than the area of the diaphragm 16, on which the high pressure is impressed by the refrigerant gas in the second chamber 5*b*, a sufficient force is given to push the valve ball 13 against the valve seat 14*b*, thereby to stop the adverse flowing-in of the high temperature high pressure refrigerant gas into the evaporator through the second capillary tube 6*b*. Therefore, no adverse heat load is impressed on the evaporator 7.

Next, the operation when the rotary compressor 1 is started is described. At an instant immediately before a starting of the rotary compressor 1, the pressure at the inlet port 10*a* to the first chamber of the fluid-controlled valve 5' is high as a result of equilibrium with the pressure in the closed housing, and the pressure in the first chamber is low and the pressure in the third chamber is retained high as a result of the equilibrium with the pressure in the closed housing 2. As a result of rapid pressure decrease in the suction line 9 after the start of rotary compressor 1, the pressure in the third chamber 5*c* becomes lower than the pressure in the first chambe 5*a* of the fluid-controlled valve 5', and then the diaphragm 16 moves downward to open the valve 15. As a result of opening the valve 15, the pressure in the first chamber 5*a* rises, and therefore the diaphragm 16 is retained in pushed down state thereby retaining the valve 15 unseated. On the other hand, the leaf valve 21 is opened as a result of decreased pressure in the suction line 9. Thus the refrigerant passes through the refrigerating apparatus from the rotary compressor 1 through the condenser 4, the first capillary tube 6*a*, the first chamber 5*a*, the second capillary tube 6*b*, the evaporator 7, the third chamber 5*c*, suction line 9 and back to the rotary compressor 1, thereby carrying out the refrigeration cycle.

EXAMPLE 5

In the foregoing examples, the diaphragms 16 is prestressed to be urged in a predetermined direction. But in order to achieve more accurate operation and to eliminate undesirable malfunctioning due to fluctuation or scatter of the prestressed force of the diaphragm from the designed value, it is desirable to provide some adjusting means. This example 5 shown in FIG. 8 has such adjusting means.

Figure 8:
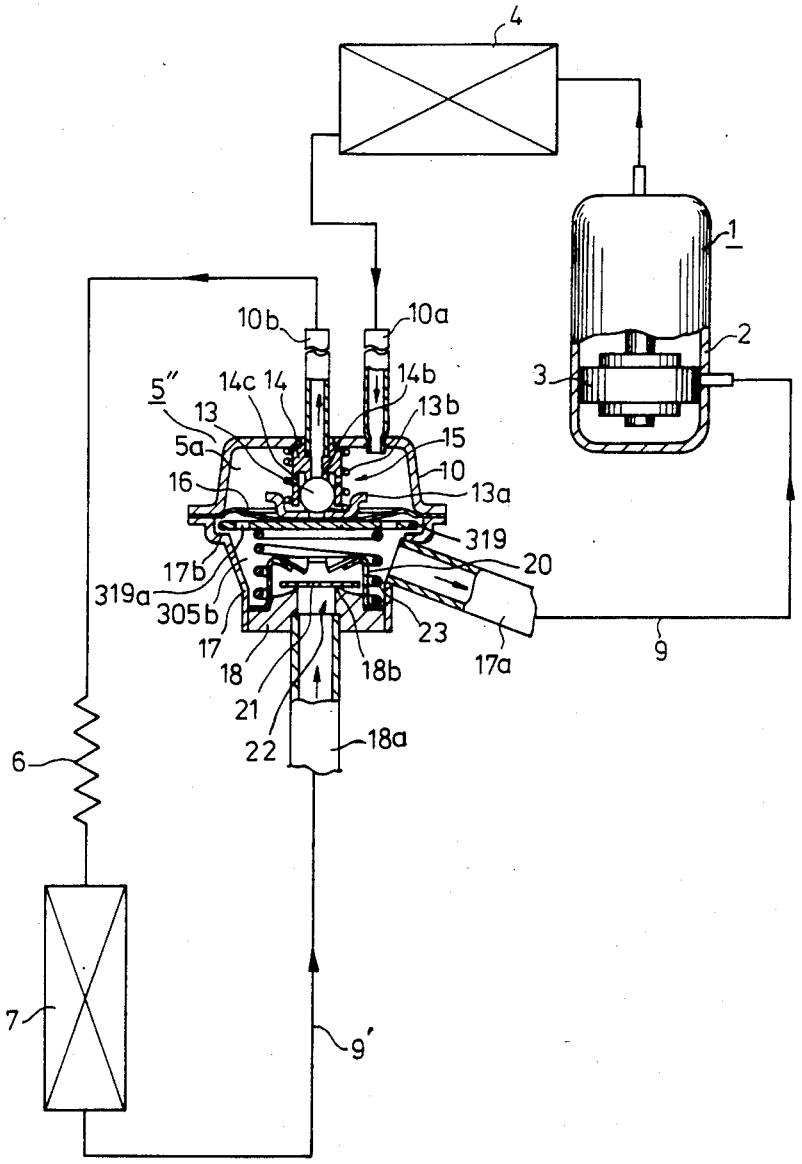
FIG. 8 is a fluid circuit diagram of another refrigerating apparatus embodying the present invention with sectional views for some components.

FIG. 8 shows the fifth example, wherein components and parts corresponding to those of the first example are shown by corresponding numerals and the corresponding descriptions made for the first example apply.

General circuit configuration of the system is substantially the same as example 2 shown in FIG. 5, but the fluid controlled valve 5'' is modified as follows:

The lower shell 17 and the diaphragm 16 define a second chamber in which a shoulder part 17*b* is used so as to receive the peripheral edge portion of a disk shaped stopper 319 to prevent excessive downward motion of the diaphragm 16. The stopper 319 has several through-holes 319*a* for free impression of the refrigerant gas pressure on the diaphragm 16. The center part of the stopper 319 is fixed to the diaphragm 16. An adjusting spring 23, which is a compression coil spring, is provided between the upper face of the block 18 and the lower face of the stopper 319, and the retainer 20 is disposed inside the adjusting spring 23. The strength of the adjusting spring 23 is adjusted by adjusting the height level of the block 18 with respect to the lower shell 17. This can be done by, for instance, after adjusting the level of the block 18 with respect to the outer shell 17, by welding the block 18 to the outer shell 17 so as to make a hermetic seal. By such adjustment, the scatter of the prestressed force of the diaphragm 16 can be compensated, thereby to acheive a designed characteristic of the valve. Also by suitably selecting the adjusting spring 23, a wide variety of the characteristic of the fluid controlled valve 5'' can be obtainable.

Operation of the example of FIG. 8 is described with reference to FIG. 9 which shows characteristic curves of operation. When the rotary compressor stops, the high temperature high pressure refrigerant gas starts to leak out of the mechanical seal parts of the compressor 3 into the cylinder chamber of the compressor 1. Then the gas reversely flows out through the suction line 9 to the second chamber 305*b* thereby to stop the reverse flow to the evaporator 7 by making the leaf valve 21 to seat on the valve seat 18*b*. Therefore, the pressure in the second chamber 305*b* rapidly rises. At the initial instance, the valve 15 in the first chamber 5*a* of the fluid controlled valve 5″ is still open, and therefore the pressure in the first chamber 5*a* gradually decreases together with the pressure in the condenser 4. Then after a short time t, the diaphragm 16 is pushed up. This is because the total balance of the forces on the diaphragm, that is, the force caused by a pressure difference ΔP on the effective area S of the diaphragm 16 namely $F_P = \Delta P \times S$ and an upward force $F_C$ given by the adjusting spring 23 and a small prestressed resilient force of the diaphragm itself results in an upward force, thereby to close the valve 15. Thereafter, the pressure in the outlet port 10*b* and the capillary tube 6 decreases rapidly. As a result of this decrease, the valve ball 13 is certainly pressed on the valve seat 14*a*, and therefore the valve 15 is securely closed. The above-mentioned short time t should be preferably about 30 seconds or less. This time period t is to be designed shorter than a time period that after a stopping of the rotary compressor 1 a liquid phase refrigerant which is condensed in the condenser 4 is still making a refrigerating action by flowing through the capillary tube 6 and into the evaporator 7 for about 45–60 seconds. That is, though depending on the size of the apparatus and the compressor, the time period t should be within about 30 seconds. In order to make the above-mentioned short time period t shorter, the design should be made such that the valve 15 should be closed when the afore-mentioned pressure difference ΔP is still large. However, on the other hand, if the pressure difference ΔP would be selected to large, in a winter season when ambient temperature is low and the difference of the pressures of the condenser 4 under operation and the pressure of the evaporator 7 is not sufficiently large, there is insufficient pressure difference ΔP to open the valve 15 at a starting of the rotary compressor 1. In such case undesirable retention of the valve 15 in the closed state takes place irrespective of operation of the rotary compressor 1, thereby failing to accomplish refrigeration. In general home use of a freezer refrigerator, the ideal pressure difference ΔP should be selected about $2 \pm 0.2$ kg/cm$^2$, and for such delicate adjustment, the adjusting spring 23 is very helpfull.

When the rotary compressor restores its operation, the pressure of the second chamber 305*b* instantaneously drops and therefore the diaphragm 16 is pulled down instantaneously thereby opening the valve 15 to enable circulation of the refrigerant.

Figure 9:
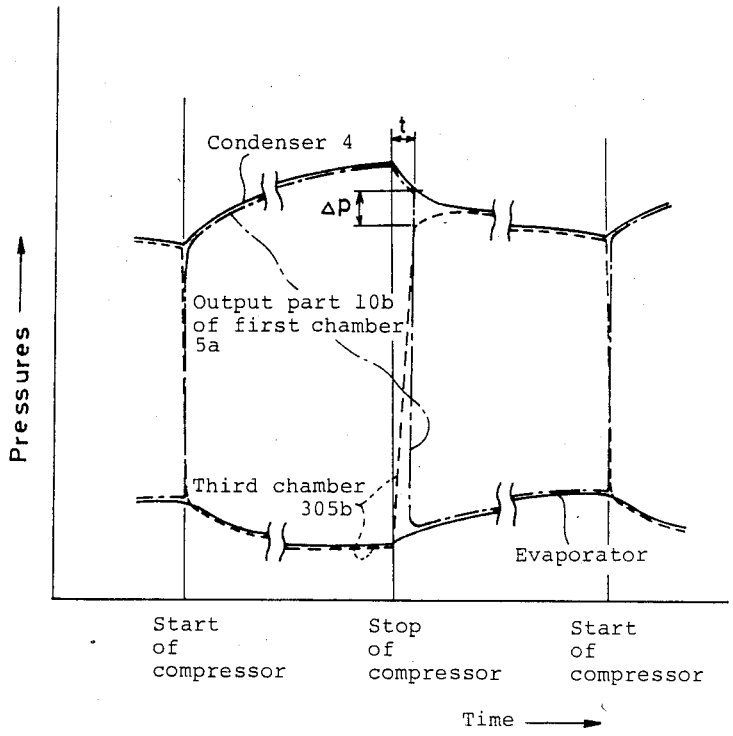
FIG. 9 is a graph showing characteristics of the refrigerating apparatus of FIG. 8.

In FIG. 9, the upper solid line shows the pressure in the condensor 4, chain line shows a change of the pressure at thee outlet port 10*b* of the first chamber 5*a* of the fluid controlled valve 5″ the broken line shows the pressure in the second chamber 305*b* of the fluid controlled valve 5″ and the lower solid line shows the pressure in the evaporator.

As has been described with respect to several preferred embodiments, example 1 to example 4, by embodying the present invention wherein undesirable flowing of the high temperature high pressure refrigerant gas into the evaporator after stopping of the rotary compressor can be effectively prevented automatically by the fluid-controlled valve, both at the upstream side of the evaporator and at the downstream side such in a manner that the valves open automatically when the rotary compressor starts operation. By such preventioon of the undesirable flow-in of the refrigerant gas into the evaporator, an undesirable heat load on the evaporator is eliminated, thereby enabling smaller temperature fluctuations in the refrigerator.

By such improvement the overall efficiency of the refrigerating apparatus is improved as much as that of the compressor itself and no particular complicated mechanical structure to respond to the pressure difference or complicated control circuits and electromagnetic valves or the like device are necessary.

The place to insert the input port and the output port of first chamber of the fluid-controlled valve can be selected in various locations as shown in the examples, and though the location of the insertion varies, the fundamental structure of the fluid-controlled valve can be substantially the same as described in the examples, and satisfactory operation is obtainable.

What is claimed is:

1. In refrigerating apparatus including a rotary compressor, a condenser, an expansion device, an evaporator, and a check valve to prevent reverse flow of refrigerant all connected in series with each other in the order recited and constituting a closed circuit with respect to the refrigerant contained therein, the combination of:

a pressure-controlled valve for controlling flow of the refrigerant to said evaporator, said valve comprising means defining a first chamber and a second chamber separated from each other by a pressure-responsive member serving as a heat exchanger between the fluids in said chambers, said first chamber being connected into said circuit between said condenser and said evaporator and said second chamber being connected into said circuit between said evaporator and said compressor, and valve means in said first chamber responsive to movements of said pressure-responsive member to control the flow of reefrigerant through said first chamber, said first chamber having an inlet port disposed at a position wherein the refrigerant flowing from said condenser is impressed substantially directly on said pressure-responsive member, said second chamber having an inlet port disposed at a position wherein the refrigerant flowing therethrough from said evaporator is impressed substantially directly on said pressure-responsive member and having an outlet port connected to said compressor, whereby during operation of said compressor the cold refrigerant in said second chamber subcools the refrigerant in said first chamber by heat exchange through said pressure-responsive member.

2. The combination defined in claim 1 wherein the check valve is disposed in the second chamber and controls reverse flow through the inlet port thereof.

3. The combination defined in claim 1 wherein the first chamber is connected into the circuit between the condenser and the expansion device.

4. The combination defined in claim 1 wherein the first chamber is connected into the chamber between the expansion device and the evaporator.

5. The combination defined in claim 1 wherein the expansion device comprises two parts and the first chamber is connected into the chamber between said parts.

6. The combination defined in claim 1 wherein the pressure-responsive member is a diaphragm.

* * * * *